US008628454B2

(12) United States Patent
Wu

(10) Patent No.: US 8,628,454 B2
(45) Date of Patent: Jan. 14, 2014

(54) SPORTS TRAINING MACHINE AND CONTROL METHOD THEREOF

(75) Inventor: Shu-Yao Wu, Taichung (TW)

(73) Assignee: Strength Master Fitness Tech Co., Ltd., Taichung (TW)

( * ) Notice: Subject to any disclaimer, the term of this patent is extended or adjusted under 35 U.S.C. 154(b) by 389 days.

(21) Appl. No.: 13/163,891

(22) Filed: Jun. 20, 2011

(65) Prior Publication Data

US 2012/0322624 A1 Dec. 20, 2012

(51) Int. Cl.
*A63B 22/04* (2006.01)

(52) U.S. Cl.
USPC ..... 482/52; 482/70; 482/51

(58) Field of Classification Search
USPC ..... 482/51–54, 57, 62, 66, 70, 71, 142
See application file for complete search history.

(56) References Cited

U.S. PATENT DOCUMENTS

| | | | | |
|---|---|---|---|---|
| 6,146,314 | A * | 11/2000 | Lee | 482/57 |
| 6,168,552 | B1 * | 1/2001 | Eschenbach | 482/52 |
| 6,196,948 | B1 * | 3/2001 | Stearns et al. | 482/52 |
| 6,277,056 | B1 * | 8/2001 | McBride et al. | 482/57 |
| 6,422,977 | B1 * | 7/2002 | Eschenbach | 482/52 |
| 6,468,184 | B1 * | 10/2002 | Lee | 482/52 |
| 7,637,848 | B1 * | 12/2009 | Chang | 482/51 |
| 7,651,444 | B2 * | 1/2010 | Lai | 482/52 |

* cited by examiner

*Primary Examiner* — Loan Thanh
*Assistant Examiner* — Rae Fischer
(74) *Attorney, Agent, or Firm* — Rosenberg, Klein & Lee

(57) ABSTRACT

A sports training machine includes a frame having a first rotational axis and a second rotational axis, both ends of which are provided with a first linkage and a second linkage. The other end of the first linkage pivotally connects to a pedal bar. The other end of the second linkage pivotally connects to a pedal installed on the pedal bar in a sliding way. The first and second linkages rotate with respect to the first and second rotational axes, respectively. The user operates the pedals to perform independent reciprocal displacements upward and downward as well as forward and backward.

10 Claims, 11 Drawing Sheets

SPORTS TRAINING MACHINE AND CONTROL METHOD THEREOF

BACKGROUND OF THE INVENTION

1. Field of Invention

The invention relates to a sports utility and, in particular, to a sports utility whose pedals can perform independent vertical and horizontal motions with two degrees of freedom.

2. Related Art

Please refer to U.S. Pat. No. 7,651,444, which discloses a sports machine shown in FIG. 11. It includes a frame 9 whose front end has a vertical support 91. The rear end of the frame 9 has a driving wheel 92. Both sides of the driving wheel 92 have a crank 93, respectively. Both sides of the support 91 are pivotally installed with a swinging arm 94, respectively. The bottom end of each of the swinging arms 94 pivotally connects to one end of a pedal bar 95, respectively. The other end of the pedal bar 95 pivotally connects to the corresponding crank 93. Therefore, when the two swinging arms 94 make an alternating motion in the forward and backward directions on the frame 9, the pedal bars 95 are driven by the swinging arms 94 and the cranks 93 to perform running-like actions.

Moreover, in the sports machine both sides of the two pedal bars 95 are provided with a sliding rail 951, respectively. A pedal 96 is installed on each of the sliding rails 951 of the pedal bars 95 in a sliding way. The pedal 96 is pivotally connected with a connecting bar 97, whose other end is pivotally connected to the support 91. The connecting bar 97 is installed with a sliding sheath 971 in a sliding way. Both ends of a movable connecting bar 972 are pivotally connected to the sliding sheath 971 and the swinging arm 94. When the two swinging arms 94 swing alternately back and forth on the frame 9, the pedal bars 95 are driven to make running motions. Moreover, the connecting bars 97 and the movable connecting bar 972 together let the pedals 96 slide back and forth on the sliding rails 961 of the pedal bars 95. This increase the step span of the running, thereby enhancing the exercising effect.

Although the pedals 96 in the conventional sports machine can have upward and downward displacements with the pedal bars 95 and have back and forth displacements as the pedal bars 95 slide, the sliding motion of the pedals 96 is correlated with the upward and downward motion. This is because the connecting relation between the connecting bars 97 and the movable connecting bars 972, and the support 91 and the swinging arms 94. That is, as the pedals 96 are driven by the pedal bars 95 to move up and downs, they are also driven by the connecting bars 97 and the movable connecting bars 972 to move back and forth along the pedal bars 95. As a result, if some component of the sports machine is out of order, e.g. some pivotal part does not have sufficient lubrication or any connecting bar is deformed or broken, then the other normal components thereof will be damaged too if one keeps using the machine. This will increase the repair and maintenance costs.

SUMMARY OF THE INVENTION

An objective of the invention is to provide a sports training machine whose pedal bars and pedals independently drive two sets of cranks, so that the pedals can perform independent reciprocal displacements upward and downward as well as forward and backward. The invention also discloses the method thereof.

Another objective of the invention is to provide a sports training machine that enables its user to self-define whether he wants to perform upward-downward stepping, forward-backward sliding, or running, taking advantage of that fact that the pedals can perform independent reciprocal displacements upward and downward as well as forward and backward.

To achieve the above-mentioned objectives, the invention includes a frame and two pedals.

The frame has a front end and a rear end. The frame is provided with a first rotational axis, a second rotational axis, a first pivotal axis, and a second pivotal axis. The two rotation axes are installed on one of the front end and the rear end.

Each of the pedals is installed on a pedal bar in a sliding way. Each pedal bar is pivotally connected to the first pivotal axis by a point other than the two ends thereof. One end of each of the pedal bars is pivotally connected with a first linkage, which in turn pivotally connects to the first rotational axis. Each of the pedals is pivotally connected with one end of a corresponding second linkage, the other end of which pivotally connects to the second rotational axis. A pivotal part is disposed between the two ends of the second linkage to pivotally connect to the second pivotal axis. As a person steps on the pedals to perform a reciprocal motion up and downs, the first linkage is driven to rotate the first rotational axis. As one steps on the pedals to perform a reciprocal motion back and forth, the second linkage is driven to rotate the second rotational axis. Thus, the pedals can perform independent reciprocal motions up and downs as well as back and forth.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
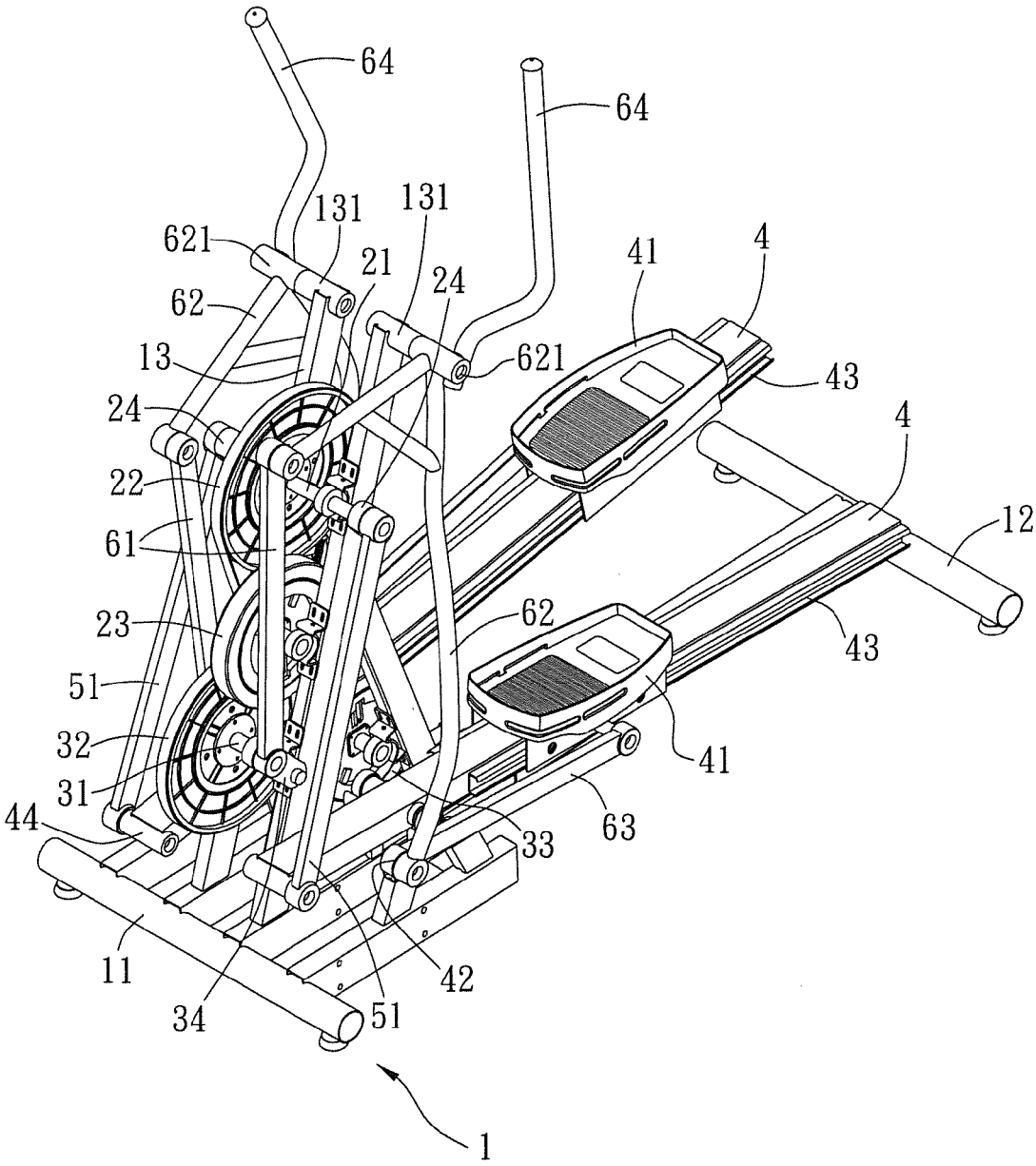
FIG. 1 is a three-dimensional view of the first embodiment of the invention.
Figure 2:
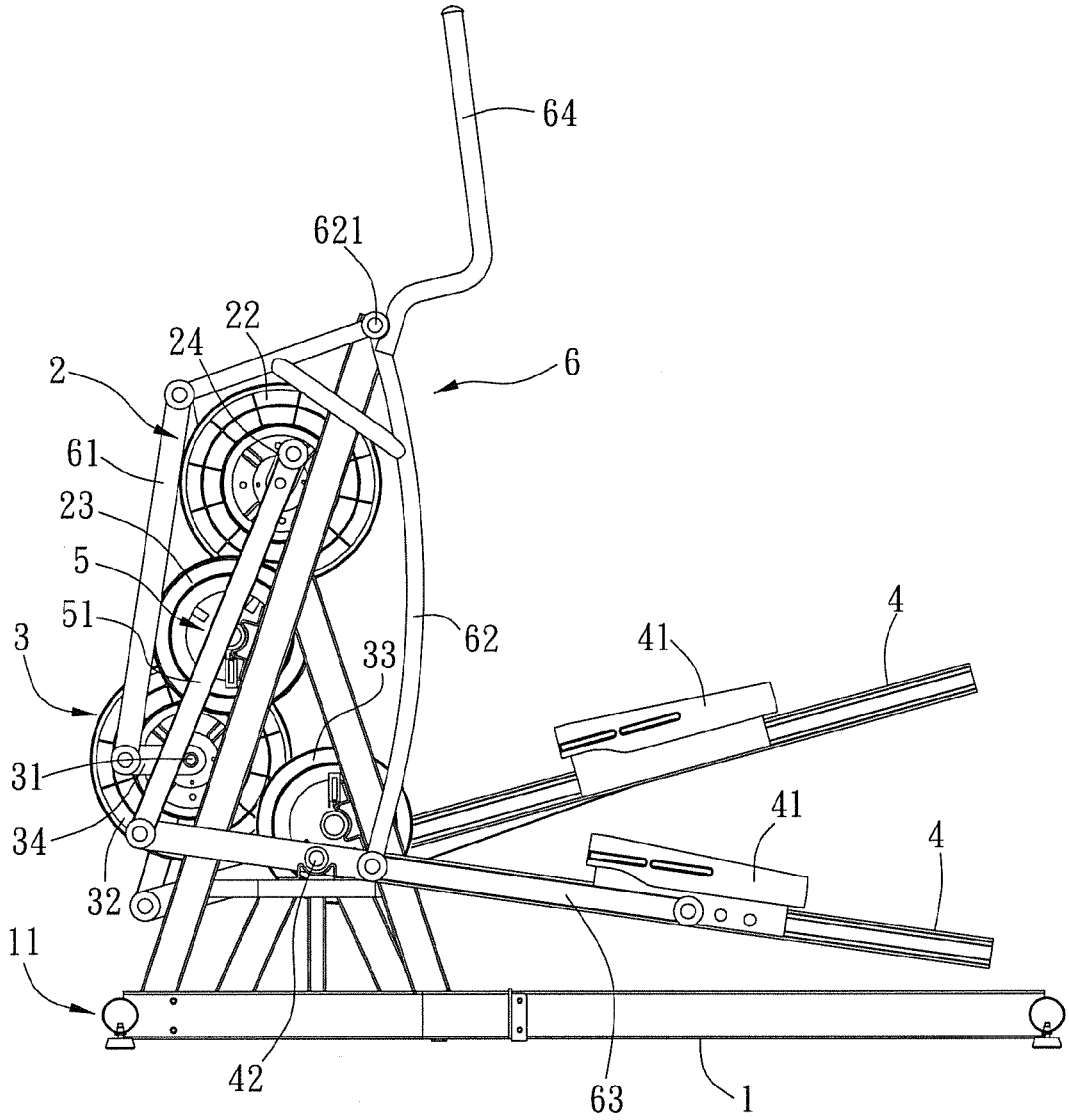
FIG. 2 is a planar side view of the first embodiment of the invention.

Please refer to FIGS. 1 and 2 for a first embodiment of sports training machine according to the invention. The machine includes: a frame 1 and two pedals 41.

The frame 1 has a front end 11 and a rear end 12. The front end 11 is vertical provided with a support 13 with a first resistance device 2 and a second resistance device 3 disposed in the vertical direction. The first resistance device 2 includes a first driving wheel 22 that rotates with respect to the first rotational axis 21 and a first resistance wheel 23 that provides resistance to the first driving wheel 22. The second resistance device 3 includes a second driving wheel 32 that rotates with respect to the second rotational axis 31 and a second resistance wheel 33 that provides resistance to the second driving wheel 32.

Each of the two pedals 41 is installed on a pedal bar 4 in a sliding way. Each of the pedal bars 4 is pivotally installed on the first pivotal axis 42 by a point other than the two ends thereof. Each of the pedal bars 4 is pivotally connected to the frame 1 via the first pivotal axis 42. One end of each of the pedal bars 4 pivotally connects to a first linkage 5. In this embodiment, the first linkage 5 includes a first crank 24 and a first transmission link 51. One end of the first crank 24 pivotally connects to the first rotational axis 21 and rotates with respect to the first rotational axis 21. One end of the first transmission link 51 pivotally connects to the first crank 24; the other end pivotally connects to one end 44 of the pedal bar 4. When the pedal bar 4 performs up-down reciprocal swings with respect to the first pivotal axis 42, the first transmission link 51 is driven to rotate the first crank 24 with respect to the first rotational axis 21. The pedals 41 are thus driven by the pedal bars 4 to perform reciprocal displacements in the vertical direction.

Both sides of each of the pedal bars 4 have a sliding rail 43, respectively. The pedal 41 is installed on the sliding rails 43 in a sliding way to slide back and forth along the sliding rails 43. One end of a second linkage 6 pivotally connects to the pedal 41, and the other end pivotally connects to the second rotational axis 31. The second linkage 6 includes a second crank 34, a second transmission link 61, a pivotal swinging bar 62, and a dragging bar 63. One end of the second crank 34 pivotally connects to the second rotational axis 31 and rotates with respect to the second rotational axis 31. One end of the second transmission link 61 pivotally connects to the second crank 34. One end of the dragging bar 63 pivotally connects to one side of the pedal 41. The body of the pivotal swinging bar 62 other than the two ends thereof has a pivotal portion 621 for a pivotal connection to the second pivotal axis 131. The pivotal swinging bar 62 thus pivotally connects to the top end of the support 13. Both ends of the pivotal swinging bar 62 pivotally connect to the second transmission link 61 and the dragging bar 63. As the pedal 41 moves back and forth, the dragging bar 63 is driven to swing the pivotal swinging bar 62. The second crank 34 is driven to rotate with respect to the second rotational axis 31. Therefore, the pedal performs a reciprocal motion in the forward and backward direction on the sliding rails 43.

Figure 3:
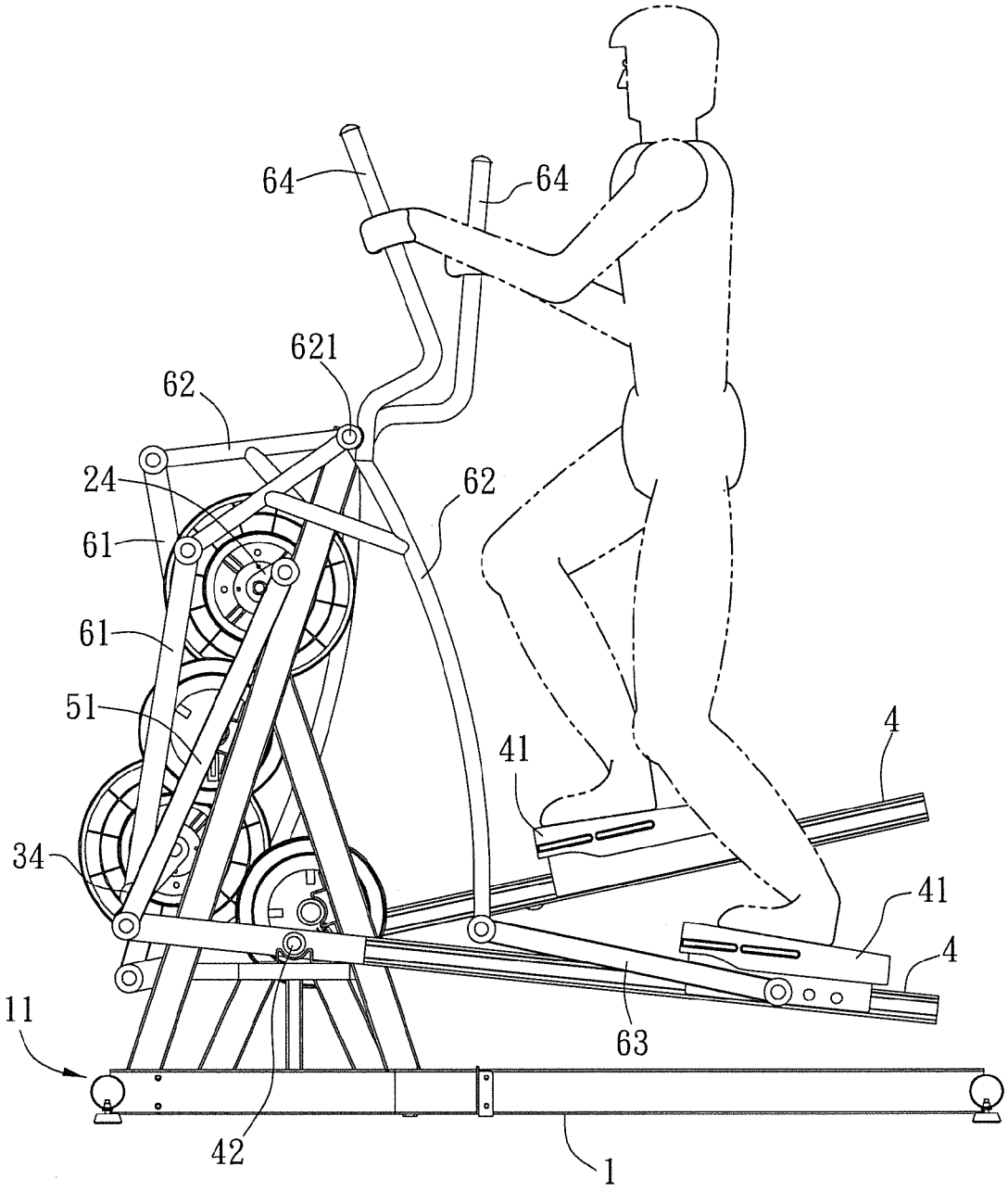
FIG. 3 is a schematic view showing the first embodiment in action.
Figure 4:
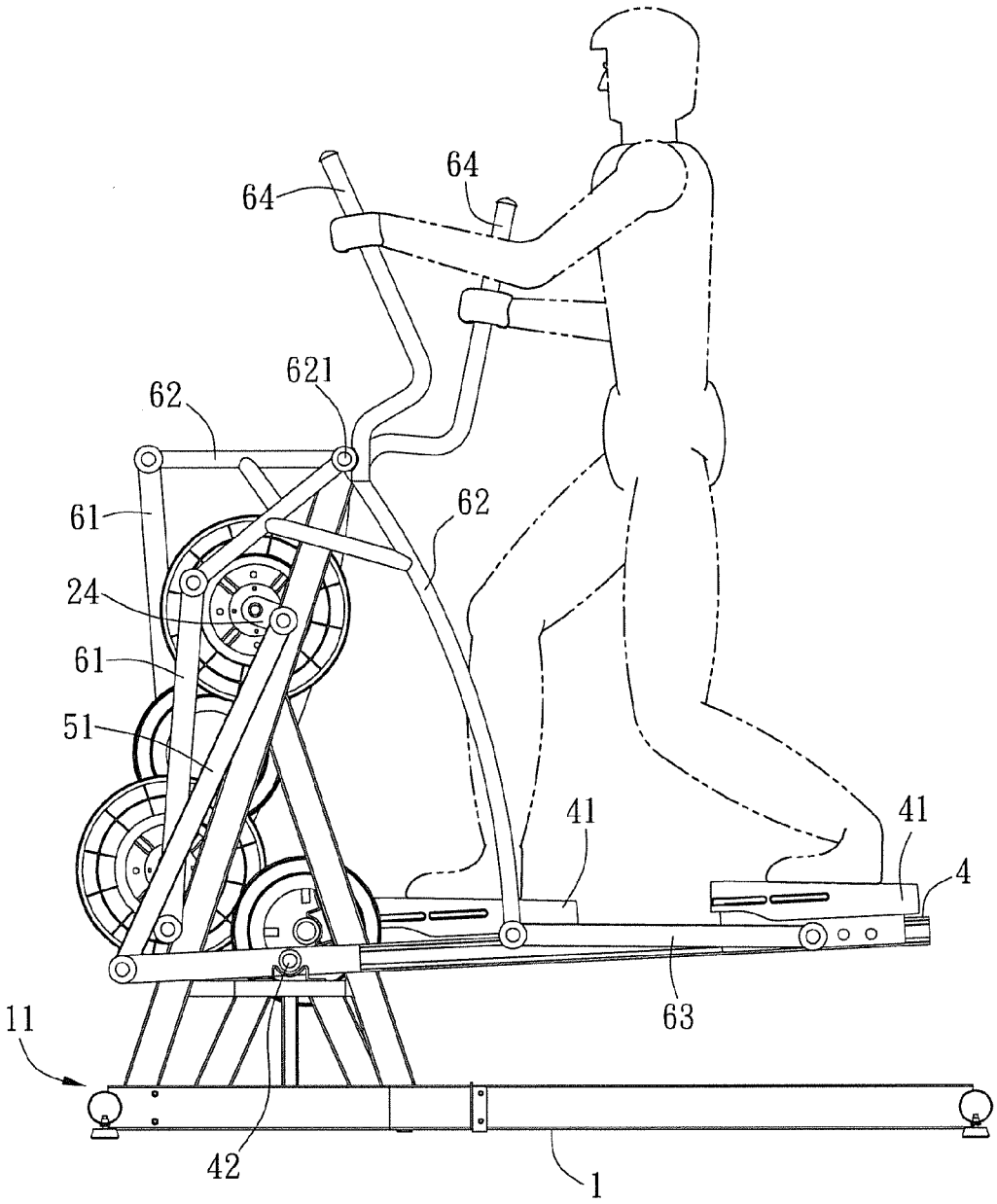
FIG. 4 is another schematic view showing the first embodiment in action.
Figure 5:
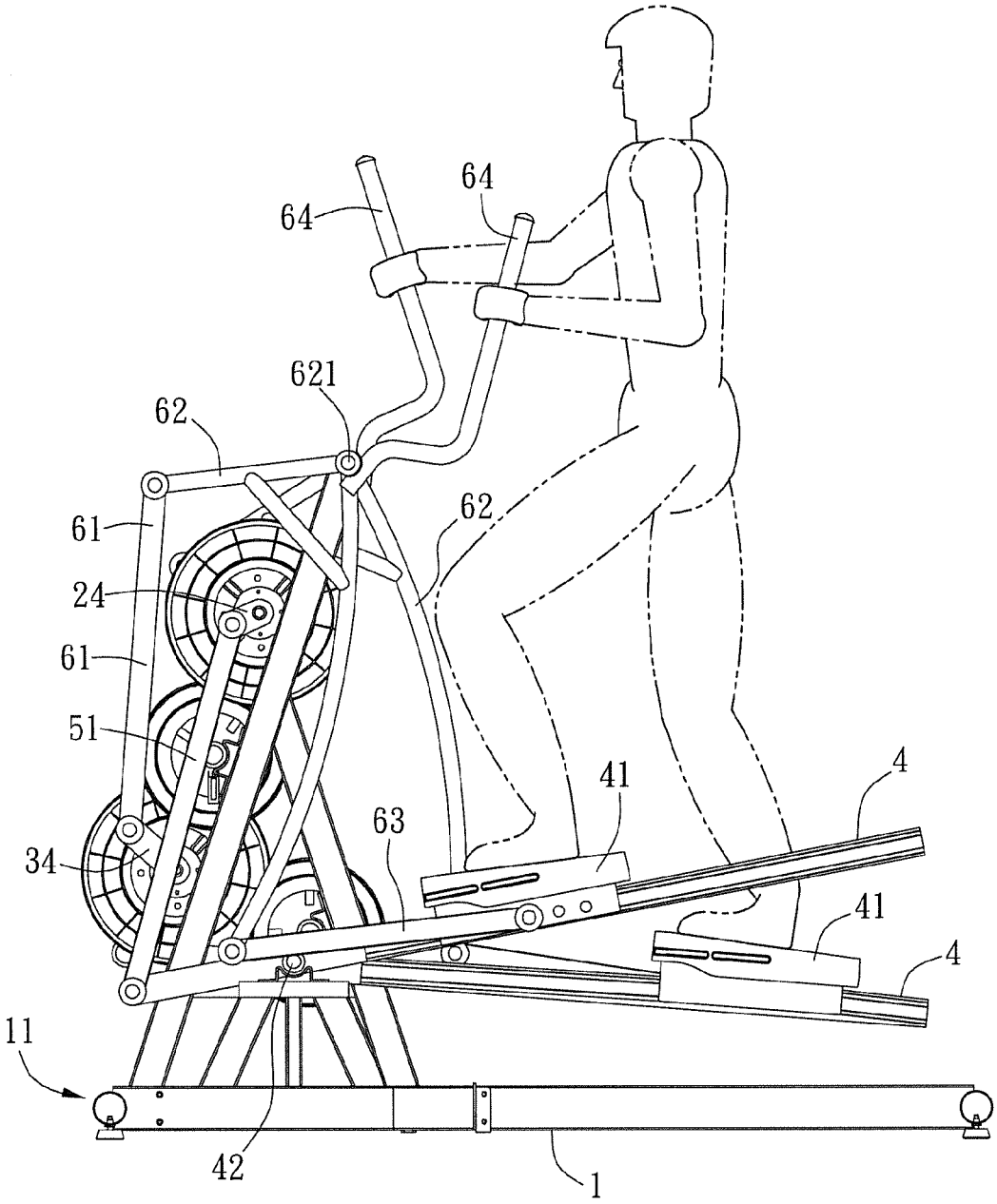
FIG. 5 is yet another schematic view showing the first embodiment in action.

In practice, as shown in FIGS. 3 to 5, a user stands on the two pedals 41 of the invention. The person exerts a force on the pedals 41 so that the pedal bars 4 pivot with respect to the first pivotal axis 42. In this case, the pedal bars 4 drive the first crank 24 via the first transmission link 51 to rotate with respect to the first rotational axis 21. When the first crank 24 rotates clockwise, the first transmission link 51 brings the pedal bar 4 to pivot upward. As the user uses both feet to step on the two pedals 41 alternately, the first crank 24 continuously rotates with respect to the first rotational axis 21, driving the pedals 41 to perform reciprocal motion in the upward and downward direction.

Moreover, the pivotal portions 621 of the pivotal swinging bars 62 are extended upward with a handle 64, respectively, for the user to hold. The user can hold the handle 64 and swings with the swinging bar 62. The second transmission link 61 drives the second crank 34 to rotate with respect to the second rotational axis 31. When the second crank 34 rotates counterclockwise, as shown in FIGS. 3 and 4, the second transmission link 61 is driven to swing the swinging bar 62 backward, thereby displacing the dragging bar backward. The pedal 41 is dragged to move backward. Please refer to FIGS. 4 and 5 simultaneously, the second transmission link 61 is driven by the second crank 34 to swing the swinging bar 62 forward, thereby displacing the dragging bar 63 forward. The pedal 41 is thus dragged to move forward. As the user alternately swings the two handles 64, the second crank 34 continuously rotates with respect to the second rotational axis 31, driving the pedals 41 to perform a reciprocal motion in the forward and backward direction.

The upward-downward and forward-backward reciprocal motions of the pedals 41 are done with the help of the first crank 24 and the second crank 34. The first crank 24 and the second crank 34 drive the first linkage 5 and the second linkage 6, respectively. The pedals 4 thus have independent upward-downward and forward-backward reciprocal motions. Both types of motions do not affect each other. This feature can prevent the situation that suppose some component is out of order, the entire structure may be damaged if the user keeps using the system. For maintenance, one only needs to check the broken component. The repair is thus simple and timesaving.

Figure 6:
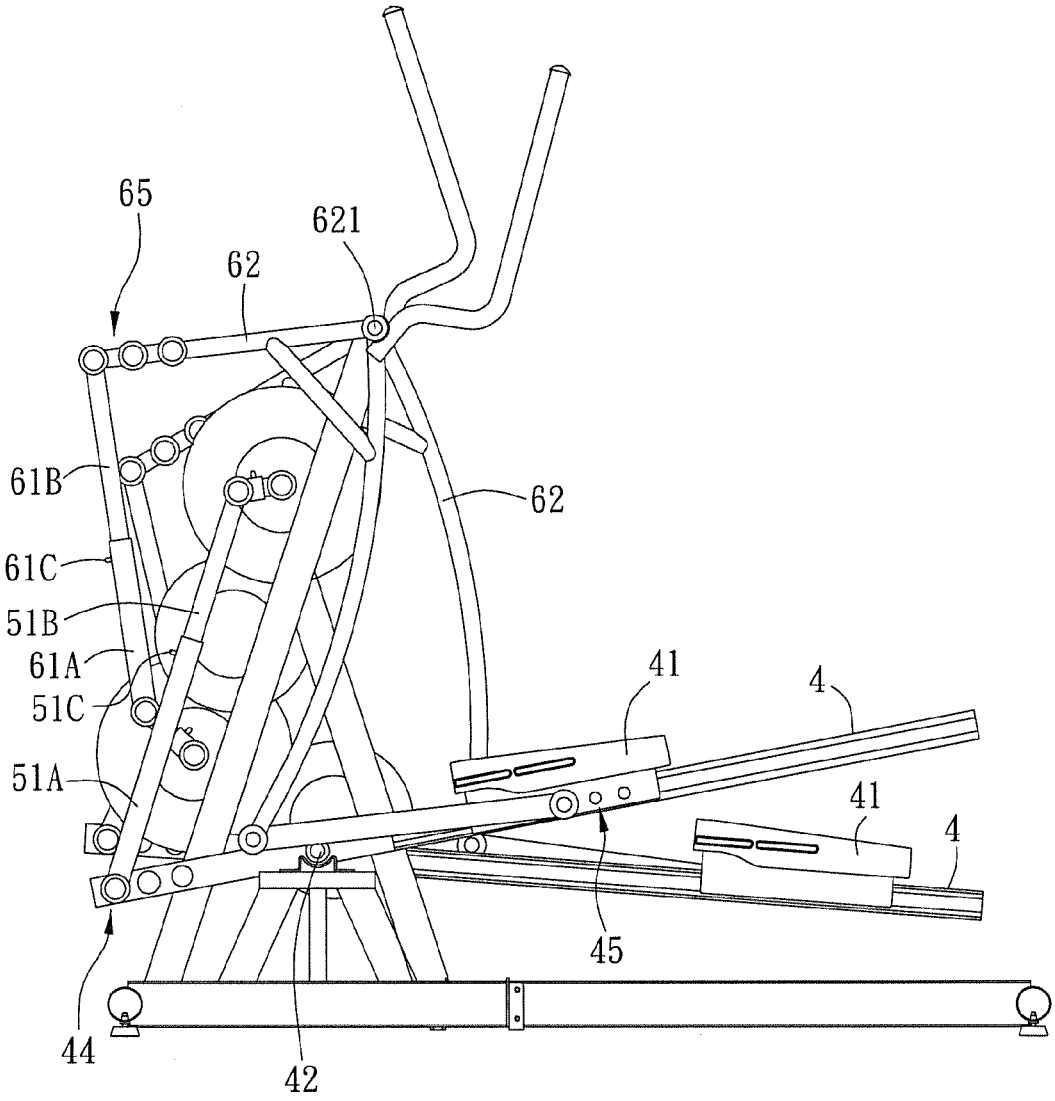
FIG. 6 is a planar side view of the second embodiment of the invention.

Please refer to FIG. 6 for a second embodiment of the invention. This embodiment differs from the first embodiment in that one can change the length of the first linkage 5 or the pivotal connecting point of the pedal bar 4 and the first linkage 5. This changes the stroke of the up-down reciprocal motion of the pedal bar 4. At least on of the first crank 24 and the first transmission link 51 is composed of an outer tube and an inner tube. The outer tube has a positioning element for positioning the inner tube with respect to the outer tube, thereby adjusting the length of the first crank 24 or the first transmission link 51. In this embodiment, the first transmission link 51 has the above-mentioned adjusting mechanism that consists of an outer tube 51A, an inner tube 51B and a positioning element 51C. One end of the pedal bar 4 has several first pivotal portions 44 with different distances to the first pivotal axis 42 for the first transmission link 51 to pivotally connect to.

Figure 8:
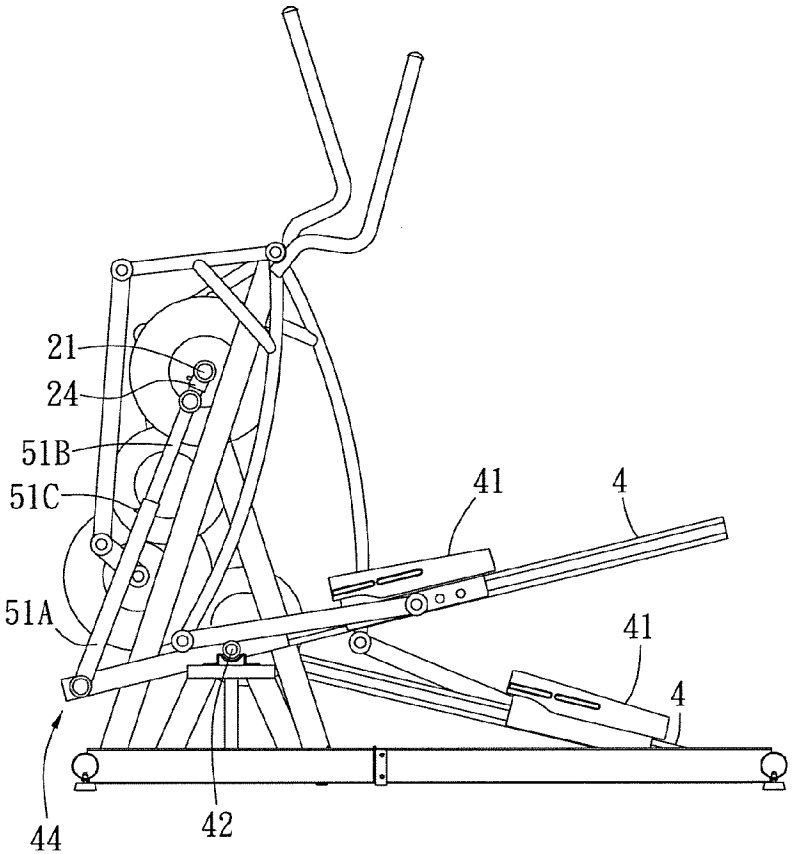
FIG. 8 is a schematic view showing the change in the stroke of pedals after reducing the length of the first transmission link in the second embodiment.
Figure 7:
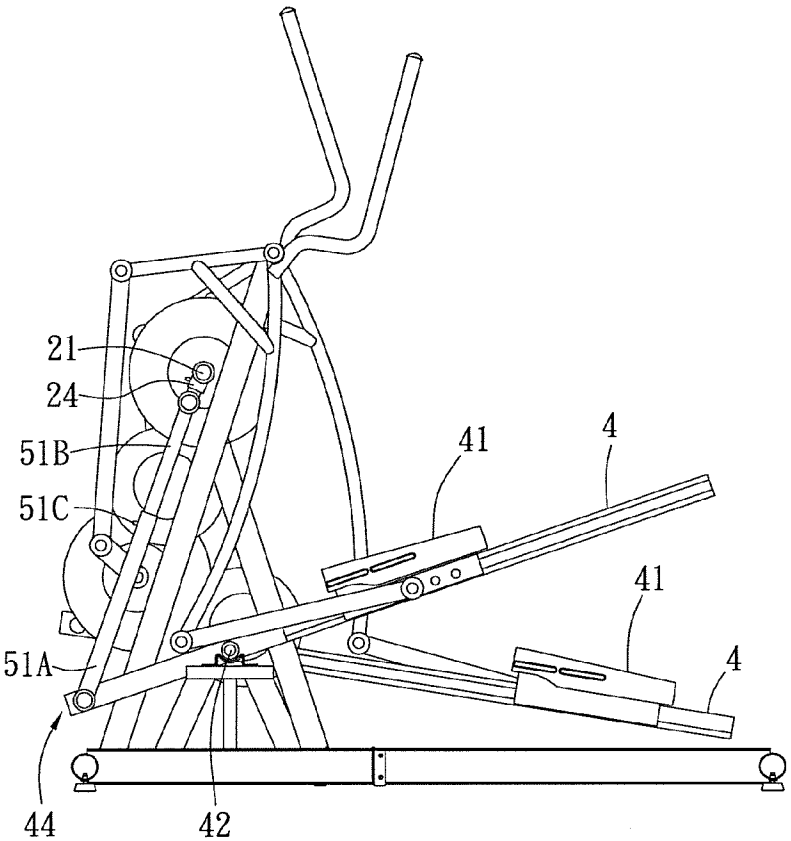
FIG. 7 is a schematic view showing the stroke of pedals before changing the length of the first transmission link in the second embodiment.

In practice, the adjusting mechanism enables one to reduce the length of the first transmission link 51, as shown in FIG. 7 and FIG. 8. When the first crank 24 rotates to drive the first transmission link 51, the pivotal amplitude of the pedal bar 4 with respect to the first pivotal axis 42 becomes larger, thereby increasing the stroke of the up-down reciprocal motion of the pedals 41.

Figure 10:
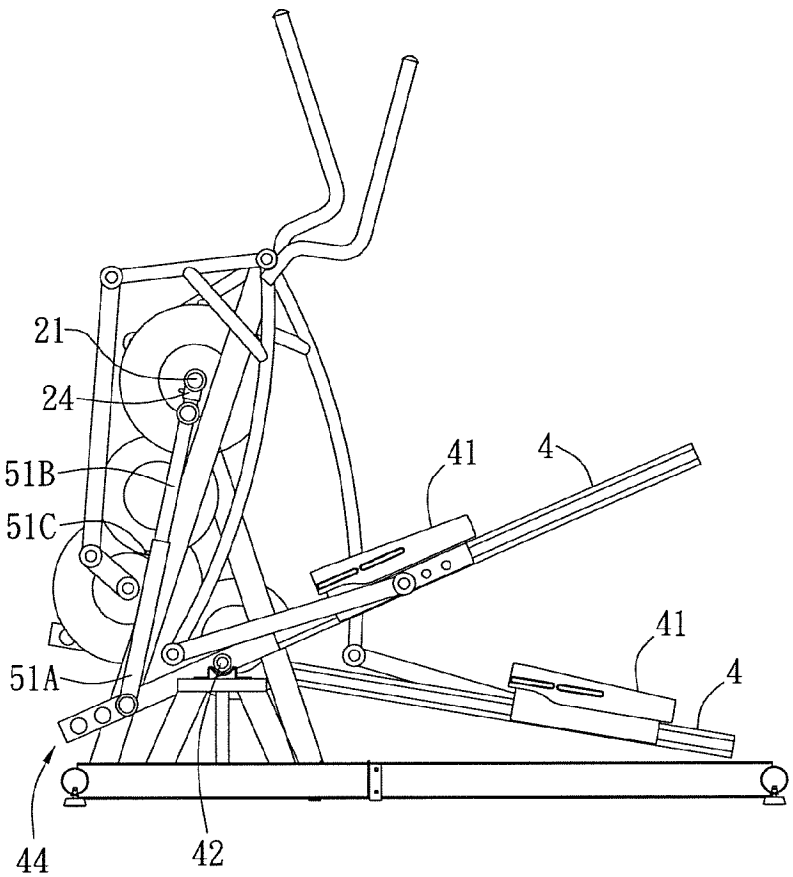
FIG. 10 is a schematic view showing the change in the stroke of pedals after changing the pivotal position between the first transmission link and the pedal bar in the second embodiment.
Figure 9:
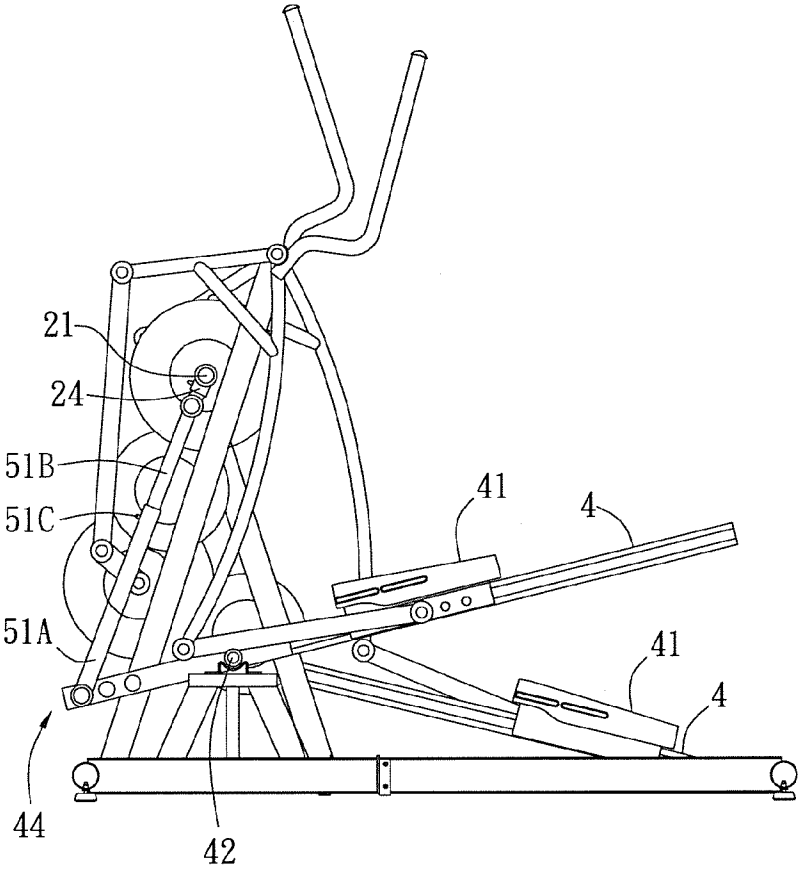
FIG. 9 is a schematic view showing the stroke of pedals before changing the pivotal position between the first transmission link and the pedal bar in the second embodiment.

Moreover, the first transmission link 51 can pivotally connect to one of the first pivotal portions 44. Since the distances between the first pivotal portions 44 and the first pivotal axis 42 are different while the up-down displacement of the first transmission link 51 driven by the first crank 24 is fixed, the pivotal amplitude of the pedal bar 4 under the force of the first transmission link 51 varies with the pivotal connecting position of the first transmission link 51 on the pedal bar 4. As shown in FIG. 9 and FIG. 10, if the pivotal connecting position is closer to the first pivotal axis 42, then the pivotal amplitude of the pedal bar 4 is larger. The stroke of the up-down reciprocal motion of the pedals 41 is also longer.

Furthermore, regarding the second linkage, at least one of the second crank 34 and the second transmission link 61 consists of an outer tube and an inner tube. The outer tube has a positioning element to position the inner tube with respect to the outer tube, thereby adjusting the length of the second crank 34 or the second transmission link 61. In this embodiment, as shown in FIG. 6, the second transmission link 61 has the above-mentioned adjusting mechanism, consisting of an outer tube 61A, an inner tube 61B, and a positioning element 61C. The end of the pivotal swinging bar 62 pivotally connected to the second transmission link 61 has several second pivotal portions 65 with different distances to the pivotal portion 621 for the second transmission link 61 to pivotally connect to.

Figure 12:
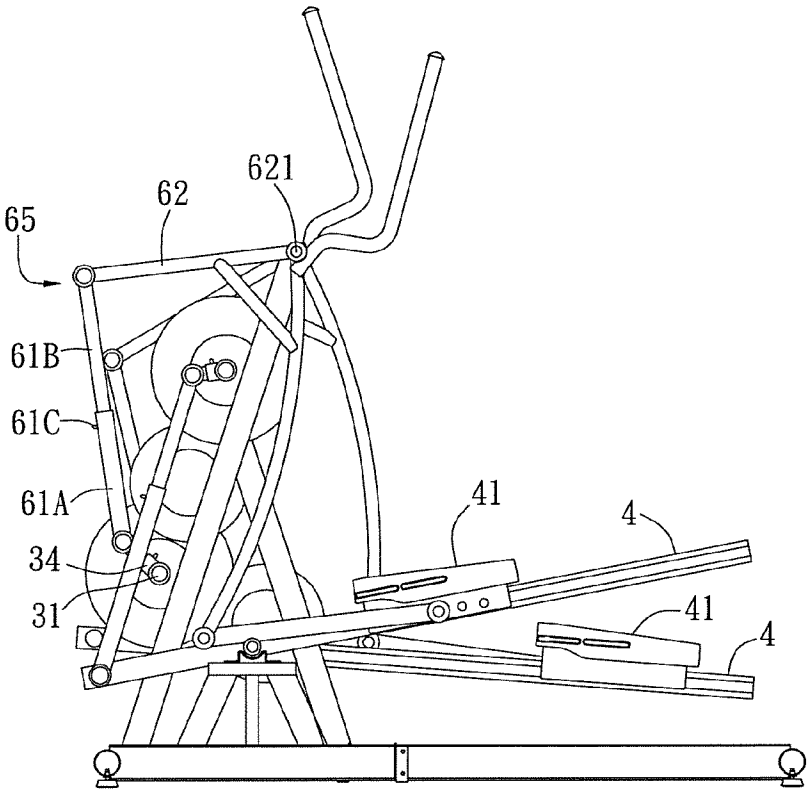
FIG. 12 is a schematic view showing the change in the stroke of pedals after reducing the length of the second transmission link in the second embodiment.
Figure 11:
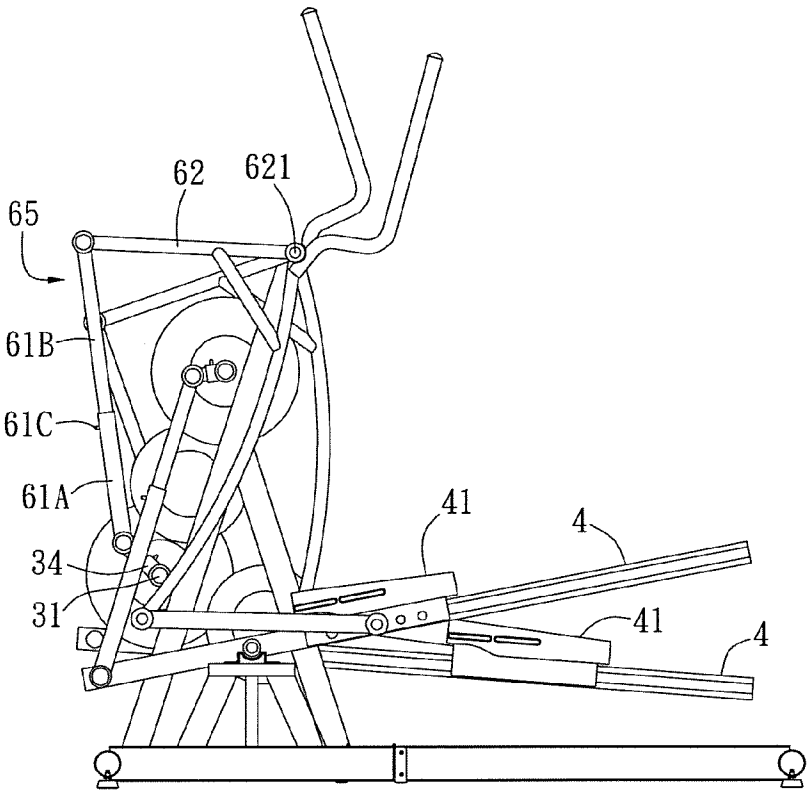
FIG. 11 is a schematic view showing the stroke of pedals before changing the length of the second transmission link in the second embodiment.

In practice, the adjusting mechanism enables one to reduce the length of the second crank 34 or the second transmission link 61, as shown in FIG. 11 and FIG. 12. When the second crank 34 rotates to drive the second transmission link 61, the swinging amplitude of the pivotal swinging bar 62 with respect to the pivotal portion 621 becomes larger, thereby increasing the stroke of the forward-backward reciprocal motion of the pedals 41 driven by the dragging bar 63. The dragging bar 63 is selectively connected to one of the third pivotal portions 45 on the pedal to change the reciprocal distance of the pedal on the pedal bar.

Figure 14:
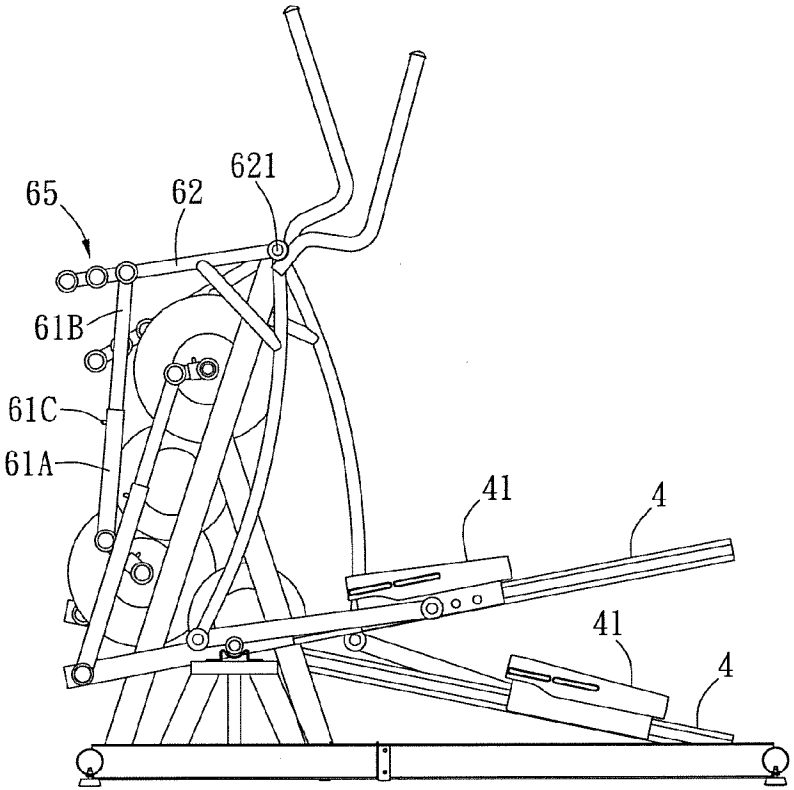
FIG. 14 is a schematic view showing the change in the stroke of pedals after changing the pivotal position between the second transmission link and the swinging bar in the second embodiment.
Figure 13:
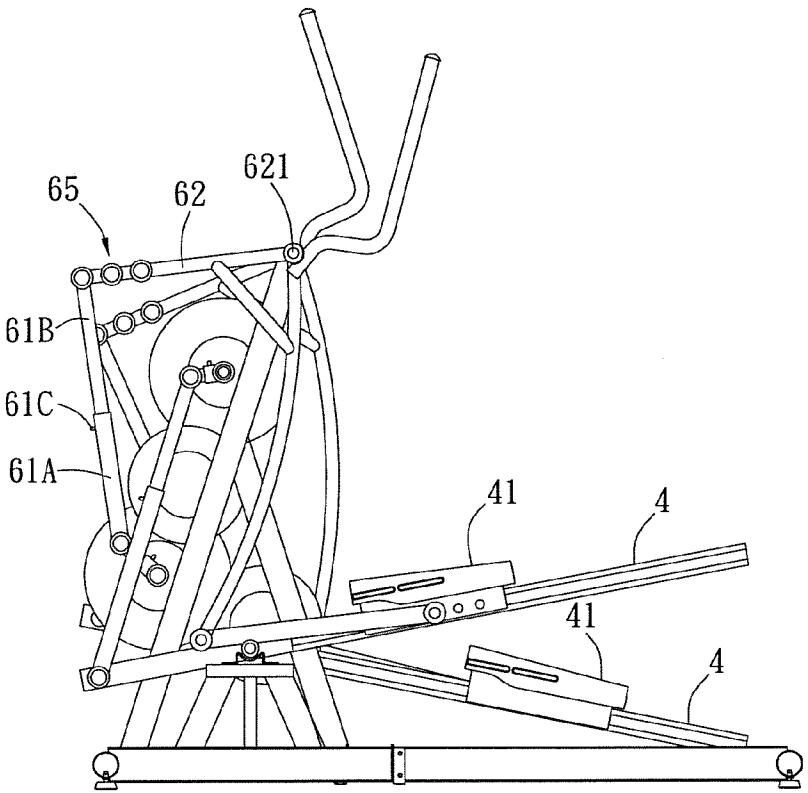
FIG. 13 is a schematic view showing the stroke of pedals before changing the pivotal position between the second transmission link and the swinging bar in the second embodiment.
Figure 15:
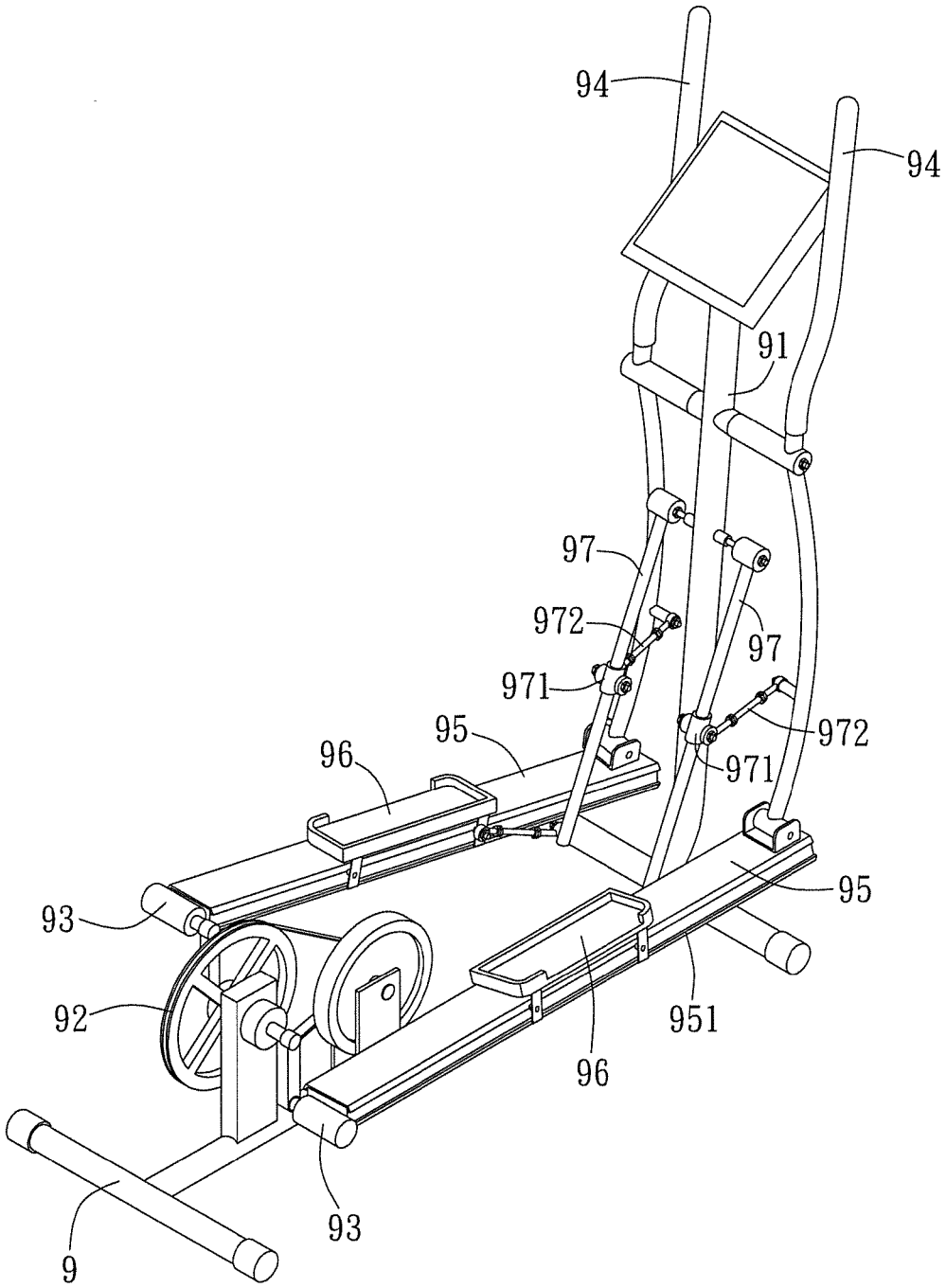
FIG. 15 PRIOR ART
FIG. 15 is a three-dimensional view of a conventional sports machine.

Moreover, the second transmission link 61 can be selectively connected to one of the second pivotal portions 65. Since the distances between the second pivotal portions 65 and the pivotal portion 621 are different while the up-down displacement of the second transmission link 61 driven by the second crank 34 is fixed, the swinging amplitude of the pivotal swinging bar 62 under the force of the second transmission link 61 varies with the pivotal connecting position of the second transmission link 61 on the pivotal swinging bar 62. As shown in FIG. 13 and FIG. 14, if the pivotal connecting position is closer to the pivotal portion 621, then the swinging amplitude of the pivotal swinging bar 62 is larger. The stroke of the forward-backward reciprocal motion of the pedals 41 driven by the dragging bar 63 is also longer.

Finally, two resistance devices of the disclosed sports training machine provide two resistance values to choose. The invention thus can have different resistances in forward-backward and upward-downward directions. A first resistance device 2 and a second resistance device 3 are disposed on same side of a frame 1. A second linkage 6 has three pivotal connecting ends, with a first pivotal connecting end pivotally connecting to a pedal 41, a second pivotal connecting end pivotally connecting to the second resistance device 3, and a third pivotal connecting end pivotally connecting to the frame 1. Therefore, the second linkage 6 swings pivotally with respect to the frame 1. The forward-backward motion of the pedal 41 drives the second linkage 6 to drive the second resistance device 3. One end of a pedal bar 4 is connected to the first resistance device 2 via a first linkage 5. The body of the pedal bar other than the two ends thereof is pivotally connected to the frame 1. The up-down motion of the pedal bar 4 drives the first linkage 5 to drive the first resistance device 2. The invention thus has a control method to provide two resistances.

According to the above-mentioned two embodiments, when the resistance of the first resistance device is adjusted to a maximum that is greater than the resistance of the second resistance device, the forward-backward motion is smoother while the upward-downward motion is more restricted. This configuration can simulate sliding. When the resistance of the first resistance device is adjusted to a minimum that is smaller than the resistance of the second resistance device, the forward-backward motion is more restricted while the upward-downward motion is smoother. This configuration can simulate stepping vertically.

The above-mentioned second embodiment can be used for users of different builds. It can adjust the strokes of the pedals according to the step span and height, in accord with human factors engineering.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A sports training machine, comprising: a frame having a front end and a rear end, a first rotational axis, and a second rotational axis, wherein each of the rotational axes provides 360 degrees of rotation, a first pivotal axis, and a second pivotal axis, with the two rotational axes installed on the same end of the frame; two pedal bars and two pedals, each of which is installed on a separate one of the pedal bars in a sliding way; wherein each of the pedal bars pivotally connects to the first pivotal axis by a point other than the two ends thereof; one end of each of the pedal bars is pivotally connected to a first linkage, which in turn pivotally connects to the first rotational axis; each of the pedals pivotally connects to one end of a corresponding second linkage; the other end of the second linkage pivotally connects to the second rotational axis; a pivotal portion is provided between the two ends of the second linkage to pivotally connect each pedal to the second pivotal axis; an up-down reciprocal motion of the pedal bars drives the first linkage to rotate the first rotational axis; and a forward-backward reciprocal motion of the pedals drives the second linkage to rotate the second rotational axis, so that the pedals perform upward-downward and forward-backward reciprocal motions.

2. The sports training machine of claim 1, wherein the first linkage includes a first transmission link and a first crank; one end of the first transmission link pivotally connects to one end of the first crank; the other end of the first crank connects to the first rotational axis to rotate; and the other end of the first transmission link pivotally connects to one end of the pedal bar so that when the pedal bar reciprocally moves with respect to the first pivotal axis, the pedals perform upward-downward and forward-backward reciprocal motions due to the connection of the pedal bars.

3. The sports training machine of claim 1, wherein the length of any component of the first linkage or the pivotal connecting point of the pedal bar to the first linkage is adjustable to change the stroke of the reciprocal motion of the pedal bar in the upward-downward direction.

4. The sports training machine of claim 1, wherein the second linkage includes a second crank, a second transmission link, a swinging link, and a dragging link; one end of the second crank pivotally connects to the second rotational axis and rotates with respect to the second rotational axis, the other end of the second crank pivotally connects to the second transmission link, one end of the dragging link pivotally connects to the pedal, a pivotal portion is provided on the body of the swinging link other than the two ends thereof, the swinging link pivotally connects to the frame via the pivotal portion, both ends of the swinging link pivotally connect to the second transmission link and the dragging link, respectively, for the pedals to perform forward-backward reciprocal motions.

5. The sports training machine of claim 1, wherein the length of any component of the second linkage or the pivotal connecting point of any two adjacent components thereof is adjustable to change the stroke of the pedal in the forward-backward direction.

6. The sports training machine of claim 1, wherein the pivotal connecting point of the second linkage and the pedal is adjustable to change the stroke of the pedal in the forward-backward direction.

7. The sports training machine of claim 1, wherein the first rotational axis and the second rotational axis connect to a first resistance device and a second resistance device, respectively.

8. The sports training machine of claim 1, wherein each pedal bar has a sliding rail and each pedal is installed on the respective pedal bar sliding rail in a sliding way to move back and forth reciprocally.

9. A resistance control method for a sports training machine, comprising: a first resistance device and a second resistance device both mounted on same side of a frame; a second linkage having three pivotal connecting ends, with a first pivotal connecting end connecting to a pedal, a second pivotal connecting end connecting to the second resistance device, and a third pivotal connecting end connecting to the frame so that the second linkage swings on the frame as the pedals moves back and forth, thereby driving the second resistance device; and a pedal bar, wherein one end of the pedal bar is connected to the first resistance device via a first linkage and wherein a point of the pedal bar other than the two ends thereof is pivotally connected to the frame; wherein the upward-downward motion of the pedal bar drives the first linkage to drive the first resistance device, thereby providing two resistances.

10. The resistance control method of claim 9, wherein the resistance provided by the first resistance device is adjustable to be greater than or not greater than the resistance provided by the second resistance device.

* * * * *